US007971688B2

(12) United States Patent
Perälä et al.

(10) Patent No.: US 7,971,688 B2
(45) Date of Patent: Jul. 5, 2011

(54) ADJUSTMENT OF TRANSPORT SYSTEM PARAMETERS USING A POWER MODEL

(75) Inventors: Pekka Perälä, Kerava (FI); Tapio Tyni, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 12/775,219

(22) Filed: May 6, 2010

(65) Prior Publication Data

US 2010/0276230 A1 Nov. 4, 2010

Related U.S. Application Data

(63) Continuation of application No. PCT/FI2008/000125, filed on Nov. 10, 2008.

(30) Foreign Application Priority Data

Nov. 14, 2007 (FI) ..... 20070865

(51) Int. Cl.
*B66B 1/28* (2006.01)

(52) U.S. Cl. ..... 187/293; 187/393

(58) Field of Classification Search ..... 187/247, 187/248, 293, 296, 297, 289, 380–389, 391–393; 318/561, 565, 615–618, 620; 700/28–31
See application file for complete search history.

(56) References Cited

U.S. PATENT DOCUMENTS

| | | | | | |
|---|---|---|---|---|---|
| 3,743,055 | A * | 7/1973 | Hoelscher et al. | ..... | 187/293 |
| 4,263,988 | A * | 4/1981 | Inaba et al. | ..... | 187/297 |
| 4,512,442 | A * | 4/1985 | Moore et al. | ..... | 187/393 |
| 4,684,856 | A * | 8/1987 | Kahkipuro | ..... | 388/820 |
| 5,157,228 | A * | 10/1992 | Ackermann et al. | ..... | 187/247 |
| 5,430,642 | A | 7/1995 | Nakajima et al. | | |
| 5,777,280 | A * | 7/1998 | Braasch et al. | ..... | 187/393 |
| 6,199,667 | B1 | 3/2001 | Fischgold et al. | | |
| 7,609,534 | B2 * | 10/2009 | Agirman et al. | ..... | 363/36 |
| 7,743,890 | B2 * | 6/2010 | Nikovski et al. | ..... | 187/382 |
| 2004/0117040 | A1 | 6/2004 | Sayyarrodsari et al. | | |
| 2006/0217898 | A1 | 9/2006 | Pernestal | | |
| 2008/0105499 | A1 * | 5/2008 | Tyni et al. | ..... | 187/382 |
| 2008/0308361 | A1 * | 12/2008 | Nikovski et al. | ..... | 187/385 |
| 2010/0000825 | A1 * | 1/2010 | Smith et al. | ..... | 187/393 |

FOREIGN PATENT DOCUMENTS

| | | | |
|---|---|---|---|
| WO | WO 98/47806 | A2 | 10/1998 |
| WO | WO 98/57878 | A2 | 12/1998 |
| WO | WO 2006/043926 | A1 | 4/2006 |

* cited by examiner

*Primary Examiner* — Jonathan Salata
(74) *Attorney, Agent, or Firm* — Birch, Stewart, Kolasch & Birch, LLP

(57) ABSTRACT

A system and a method for the adaptation of parameters in a transport system involve a power model which describes power flow in the transport system by means of transport system parameters, which include input parameters and status parameters. The system and method also involve the determination of at least a first and a second input parameter, and the power model is updated on the basis of at least the first input parameter. At least one transport system status parameter is adjusted using at least the updated power model and the second input parameter thus determined.

20 Claims, 4 Drawing Sheets

ADJUSTMENT OF TRANSPORT SYSTEM PARAMETERS USING A POWER MODEL

CROSS REFERENCE TO RELATED APPLICATIONS

This application is a Continuation of PCT International Application No. PCT/FI2008/000125 filed on Nov. 10, 2008, which claims the benefit of Patent Application No. 20070865 filed in Finland, on Nov. 14, 2007. The entire contents of all of the above applications is hereby incorporated by reference into the present application.

BACKGROUND OF THE INVENTION (a) Field of the Invention

The present invention relates to an arrangement and a method for adapting the parameters of a transport system. The adaptation of parameters is implemented using a power model of the transport system.

(b) Description of Related Art

In transport systems, such as elevator systems, identification of certain system parameters is required for control and maintenance, inter alia. System parameters have traditionally been determined by calculating or testing. However, such methods entail problems resulting from inaccuracy of determination. For example, an error in the measurement of elevator system load will hamper the control of the elevator.

Specification EP1361999 describes call allocation in an elevator group using a specific energy consumption file for each elevator car.

Specification U.S. Pat. No. 5,157,228 describes a method for learning elevator control adjustment parameters.

BRIEF DESCRIPTION OF THE INVENTION

The object of the present invention is to disclose an arrangement and a method for adapting the parameters of a transport system by using a specific power model describing power flow in the transport system. When transport system parameters are adapted according to the invention, the adaptation can be effected for even a large number of parameters using only a small amount of measurement data. The invention also allows a better accuracy to be achieved in the adaptation of parameters than in prior art.

Inventive embodiments are presented in the description part of the present application. The inventive content disclosed in the application can also be defined in other ways. The inventive content may also consist of several separate inventions, especially if the invention is considered in the light of explicit or implicit sub-tasks or with respect to advantages or sets of advantages achieved. In this case, some of the attributes contained in the claims below may be superfluous from the point of view of separate inventive concepts.

The transport system according to the invention may be e.g. an elevator system, a crane system, an escalator system or a sliding walkway system.

An arrangement according to the invention for adapting the parameters in a transport system comprises a power model, which comprises a number of parameters describing power flow in the transport system. Said arrangement comprises at least a first and a second input parameter, the values of which are determined, and said power model is updated using at least the first input parameter. The arrangement also comprises at least one status parameter, whose value is adapted using at least the updated power model and the second input parameter.

'Adaptation of parameters' refers to modifying at least one status parameter so that the power model is adjusted with certain optimization criteria. 'Input parameters' refers to parameters for which the data is determined from the transport system e.g. by reading. These may include e.g. rotational speed of the traction sheave of an elevator or acceleration of the elevator car, which have been measured e.g. from an encoder attached to the traction sheave or motor shaft of the elevator, or from an acceleration sensor fitted on the top of the elevator car. An input parameter may also consist of e.g. measured motor feed power data, which can be measured e.g. from the motor currents and voltages. Similarly, 'status parameters' refers to parameters that describe the transport system but whose values have not been determined from the transport system. Status parameters may be lockable, in which case parameter adaptation is only carried out for those parameters which have not been locked. Locked parameters are held constant during adaptation. In an embodiment of the invention, the same power model according to the invention can also be used in several different parameter adaptation processes, wherein an input parameter may function in another adaptation process as a status parameter, and vice versa. In an embodiment of the invention, momentary values are read for input parameters simultaneously, and parameters that have been read simultaneously form successive sets of parameter elements in which the parameters correspond to each other.

In a method according to the invention for adapting the parameters of a transport system, a power model is fitted into the arrangement; parameters describing power flow in the transport system are fitted into the power model; at least a first and a second input parameter of the trans-port system are determined; the power model is updated on the basis of at least the first input parameter thus determined; and at least one status parameter of the transport system is adapted using the updated power model and the second input parameter.

The advantages achieved by the invention include at least one the following:

- As the status parameters of the transport system are adapted by using a power model updated on the basis of a first input parameter and by using a separately determined second input parameter, it is possible, by modifying the status parameters, to adjust the power model towards a power value derived from the second input parameter, the status parameter values being thereby also adjusted.
- Since in this power model the power flow in different parts of the transport system is modeled in a chained fashion so that the power flow at a certain point in the transport system is dependent on the power flow in other parts of the transport system, the power model can be used to adapt several transport system parameters in different parts of the transport system without necessarily requiring measurement feedback from all these parts of the transport system, the arrangement being thus simplified.
- After parameter adaptation has been carried out on the basis of power flow at a mechanical point of connection between a motor drive and a transport apparatus, it is possible to adapt parameters e.g. on the basis of measurement of motor power input and measurement of movement of the motor drive wheel.
- If transport system status parameters have been pre-selected by measurement, for example in an elevator system by measurement of elevator car load, measurement of elevator rope slip or measurement of friction between elevator car and guide rails, then the measurement error can be reduced via parameter adaptation according to the invention.
- Transport system status parameters pre-selected by calculation, such as rope constant of elevator ropes or imbalance of rope load, can also be adjusted in a manner described in the invention.

Elevator system status parameters adapted according to the invention can be used e.g. in the control of power supply to the elevator motor, and thus the control parameters, e.g. torque feedforward, of a power controller, such as a frequency converter, can be determined on the basis of these elevator system status parameters.

The power model of the invention can also be utilized e.g. in the control of traffic in an elevator system. Thus, power consumption of the elevator system determined from the power model can be used e.g. as a criterion in the allocation of elevator calls. As the parameters in the power model have now been adapted according to the invention, aforesaid traffic control is also more accurate.

Since, according to the invention, status parameters can be re-adapted during the service life of the transport system, a change caused e.g. by wear of the transport system can be taken into account by updating the status parameter values. On the other hand, this also makes it possible to observe the state of the transport system from changes in the status parameters, and this information can be utilized e.g. for maintenance.

The power model of the invention can be used for monitoring an elevator system by comparing parameters determined by the aid of the power model to parameters based on actual measurement results.

BRIEF DESCRIPTION OF THE DRAWINGS

In the following, the invention will be described in detail by referring to the attached drawings, wherein.

DETAILED DESCRIPTION OF THE INVENTION

Figure 1:
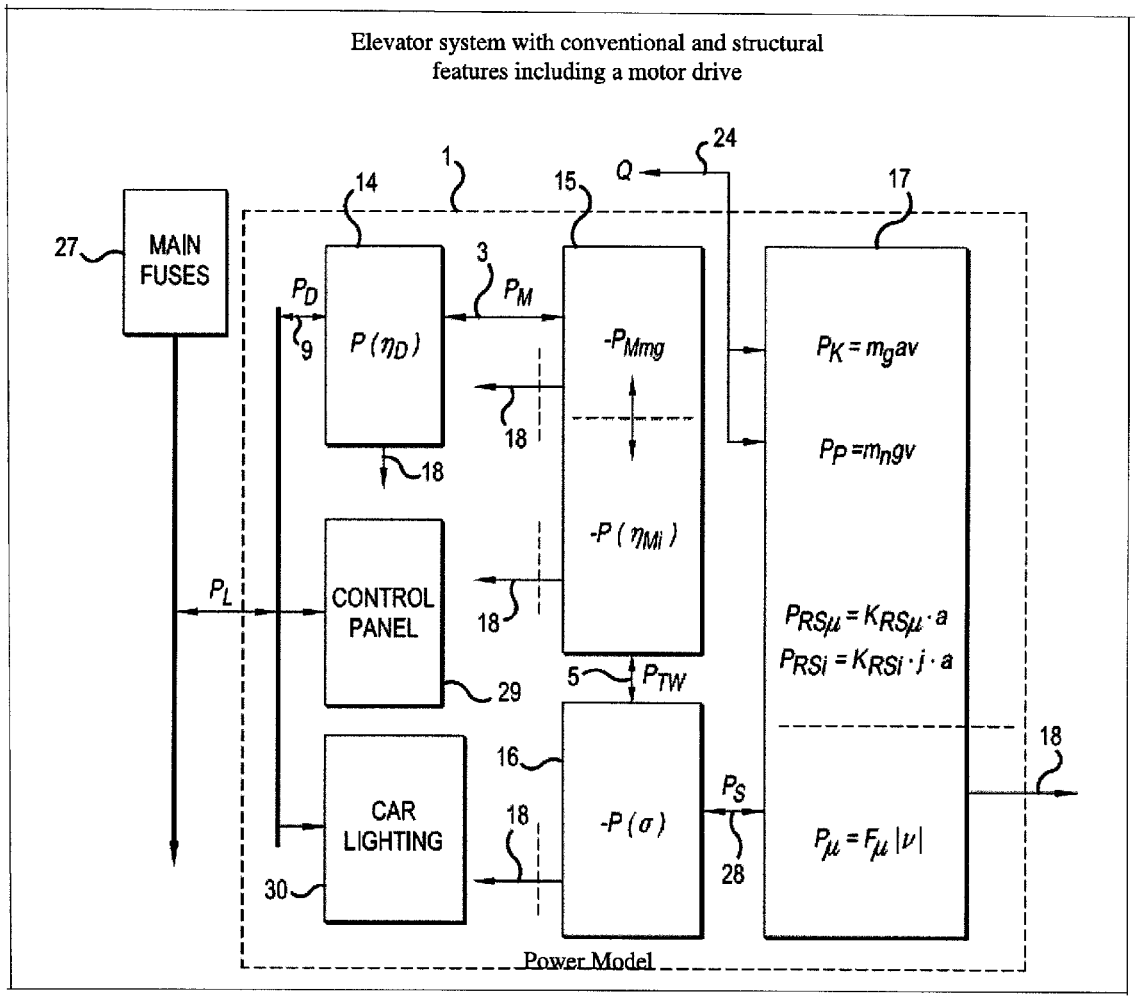
FIG. 1 represents an elevator system power model according to the invention

FIG. 1 presents a block diagram representing an elevator system power model according to the invention. In the power model, power flow in the elevator system is described by means of elevator system parameters 2, 3, 4, 13. Power is supplied to the elevator system from a power supply 27, which in this example is a network supply, but which could also be e.g. a generator. A motor power supply device 14, an elevator control panel 29 and lighting 30 receive their power feed from the power supply 27. The motor drive comprises blocks which describe power flow in the motor power supply device 14 and the elevator motor 15. The elevator car, counterweight and elevator ropes form a block 17 which describes power flow in the elevator shaft mechanics. The power to the elevator shaft mechanics flows via the elevator ropes from the elevator traction sheave 16.

The input power 9 for the motor drive is fed through the motor power supply device 14 to the elevator motor 15. The motor power supply device transmits input power 9 for use as motor supply power 3 in accordance with its efficiency ($\eta_D$), but some of the input power is converted into heat 18. A proportion of the motor supply power 3 is needed as magnetization power ($P_{Mmg}$). In addition, some power is dissipated by resistive losses in the motor windings and e.g. by eddy currents. This power dissipation is converted into heat 18. The motor transmits power with its efficiency ($\eta_{Mi}$) to the elevator shaft mechanics 17 via the elevator ropes, which are mechanically connected to the drive wheel 16. From this point of connection 5 between the motor drive and the mechanics, power is transmitted further by the elevator ropes, some of it being converted into heat 18 as the elevator ropes are slipping on the traction sheave (P(σ)). Of the power 28 passed on to the elevator shaft mechanics 17, a proportion is converted into heat by friction ($F_\mu$) in the elevator shaft, a proportion is stored as potential energy in a spring determined by the elastic constant ($K_{RS\mu}$) of the elevator ropes and a proportion as kinetic energy based on the moment of inertia $K_{Rsi}$*j of the elevator ropes. Energy is also stored as kinetic as well as potential energy of the elevator car, elevator car load and counterweight.

Figure 2:
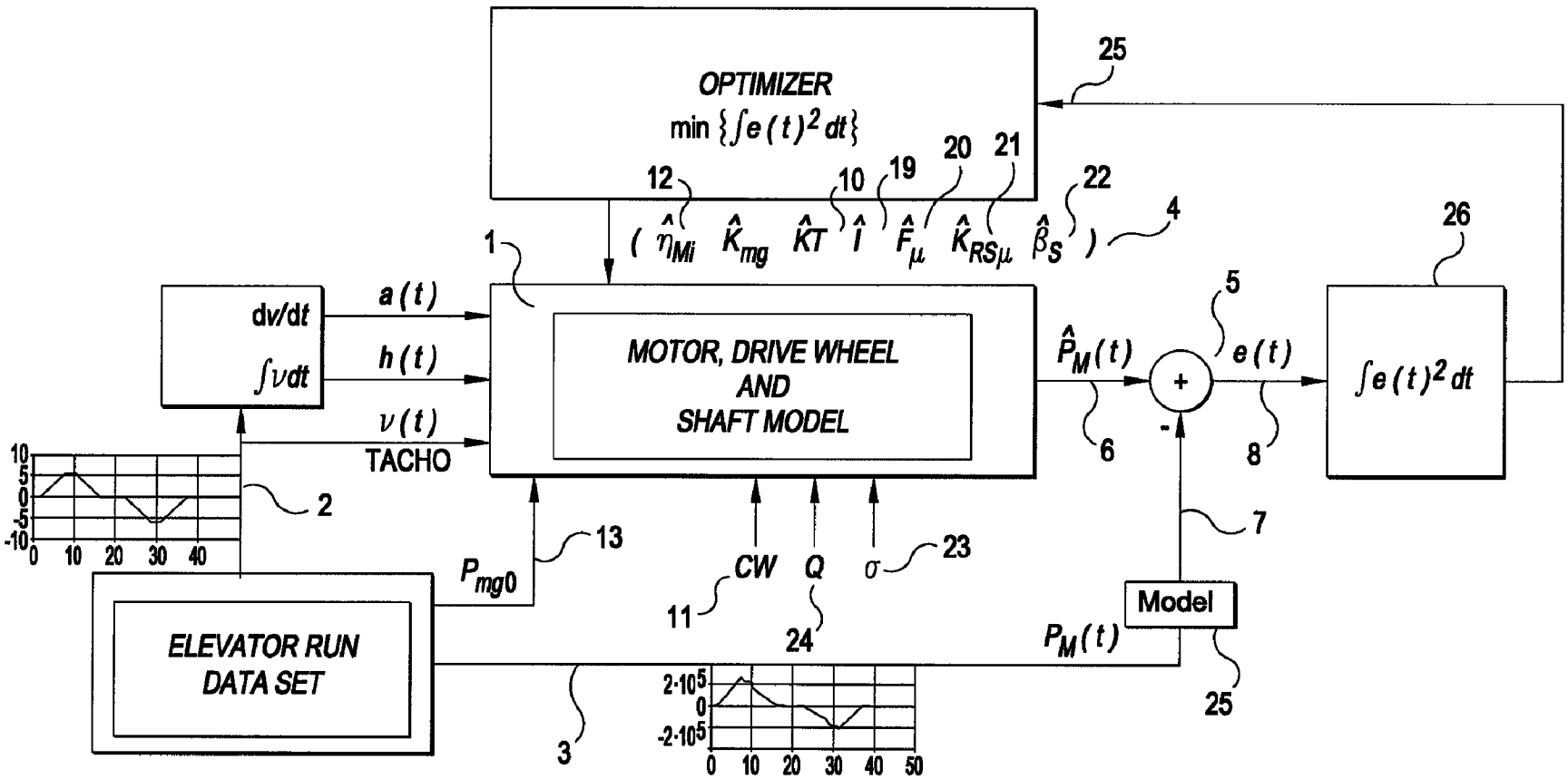
FIG. 2 represents an arrangement according to the invention for adaptation of parameters in an elevator system

FIG. 2 represents an arrangement according to the invention for the adaptation of elevator system parameters. The arrangement comprises a power model 1, which includes a number of parameters 2, 3, 4, 13 describing power flow in the transport system. In this arrangement, a first input parameter 2 contains data representing the rotational speed of the elevator motor, from which has been obtained elevator motor acceleration data via derivation and drive wheel position change data via integration. A second input parameter 3 contains the elevator motor supply power corresponding to the speed data 2, and a third input parameter 13 contains the elevator motor magnetization power corresponding to zero speed. The data of the input parameters are read simultaneously and stored as a parameter set. The read operation is repeated at regular intervals, thus forming successive parameter sets whose values are stored.

The elevator is operated by running it at least twice successively in the directions of heavy and light load, i.e. in opposite directions in the elevator shaft, and the input parameters are read. The power flow at the point of connection 5 between the motor drive and the transport apparatus mechanically connected to it is estimated by updating the power model with the elevator motor speed data and the elevator motor magnetization power corresponding to zero motor speed, these data items having been read. The power estimate 6 thus produced is compared to the corresponding power flow value 7 derived from the elevator motor supply power 3 at the aforesaid point of connection 5. Selected status parameters 4 of the power model are modified by adapting them using a cost function 25, 26 known in itself so that the estimate 6 of power flow at the point of connection 5 approaches the power flow value 7 derived from the supply power 3 of the elevator motor. The difference 8 between the estimated power 6 and the power 7 derived from the motor supply power is now determined, and the cost function 25, 26 tends to minimize this difference 8 by adapting the selected non-locked status parameters 4. At the same time, the values of the adaptable parameters are adjusted. The motor power flow 7 at the point of connection 5 has been derived from the motor supply power 3 by using a model 25 describing the motor efficiency and the traction sheave. FIG. 2 shows the following status parameters 4: motor efficiency 12, motor magnetization constant $K_{mg}$, elevator car mass 10, elevator inertia mass 19, elevator shaft friction 20, rope constant 21 of elevator rope, and variation in elevator system balance position as a function 22 of position in the elevator shaft.

Figure 3:
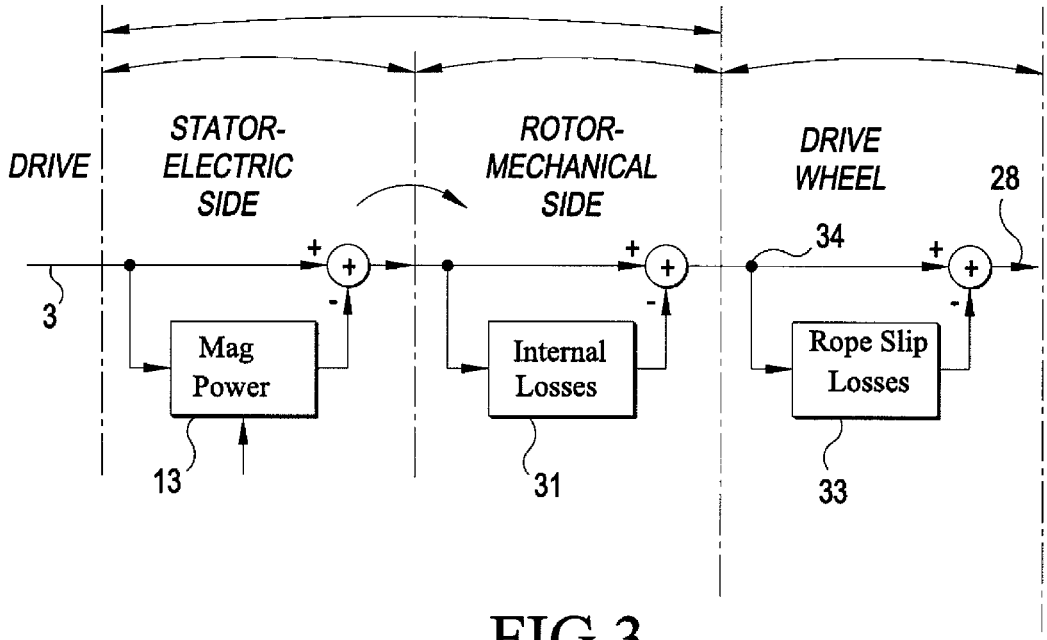
FIG. 3 represents a power model according to the invention describing motor efficiency

FIG. 3 presents a power model describing motor efficiency. Efficiency refers to the relation between the output power 28 and the supply power 3 of the motor.

Motor supply power 3 is consumed as magnetization power 13, motor friction losses, copper losses in the magnetizing windings and as eddy currents, i.e. as internal losses 31 in the motor, and as losses due to rope slip on the traction sheave. These rope slip losses can be presented as a component 33 proportional to the drive wheel power $P_{Mtw}$ 34:

$$(1-\eta_\sigma)P_{Mtw}$$

Figure 4:
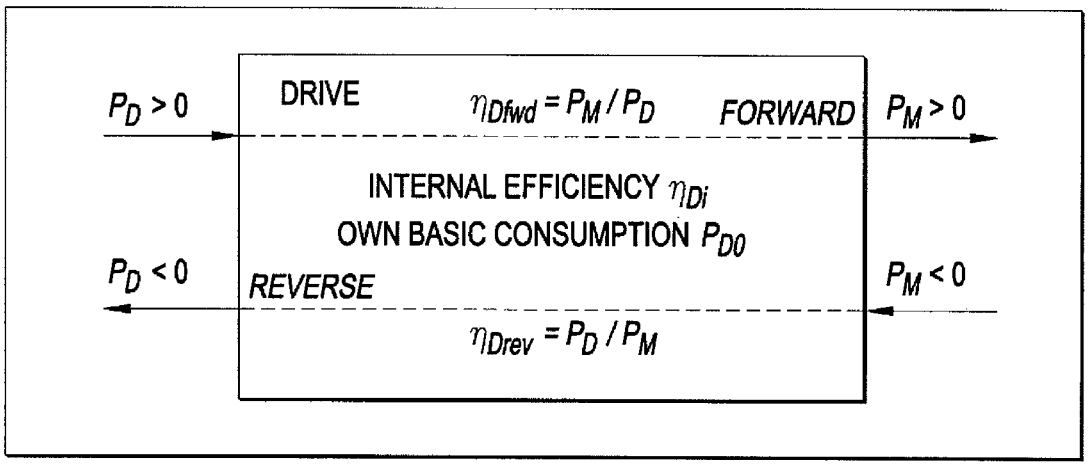
FIG. 4 represents a power model according to the invention describing the efficiency of a motor power supply device

FIG. 4 presents a power model describing the efficiency of the motor power supply device. In this power model, the efficiency is determined separately according to the direction of power transfer, in such manner that power is fed from the power source $P_D$ 27 to the motor $P_M$ 15 with the efficiency $\eta_{DFWD}$:

$$\eta_{Dfwd} = \frac{P_M}{P_D}$$

and from the motor to the power source with the efficiency $\eta_{DREV}$:

$$\eta_{Drev} = \frac{P_D}{P_M}$$

The output power $P_{out}$ in a power model block can be updated from the block input efficiency $\eta_i$, input power $P_{in}$ and initial power value $P_0$ by a linear adaptation term:

$$P_{out}(P_{in})=\eta_i P_{in}+P_0$$

The internal efficiency $\eta$ of a power model block again can be adapted using the input efficiency $\eta_i$, the input power $P_{in}$, and the initial power value $P_0$:

$$\eta(P_{in}) = \eta_i + \frac{P_0}{P_{in}}.$$

Figure 5:
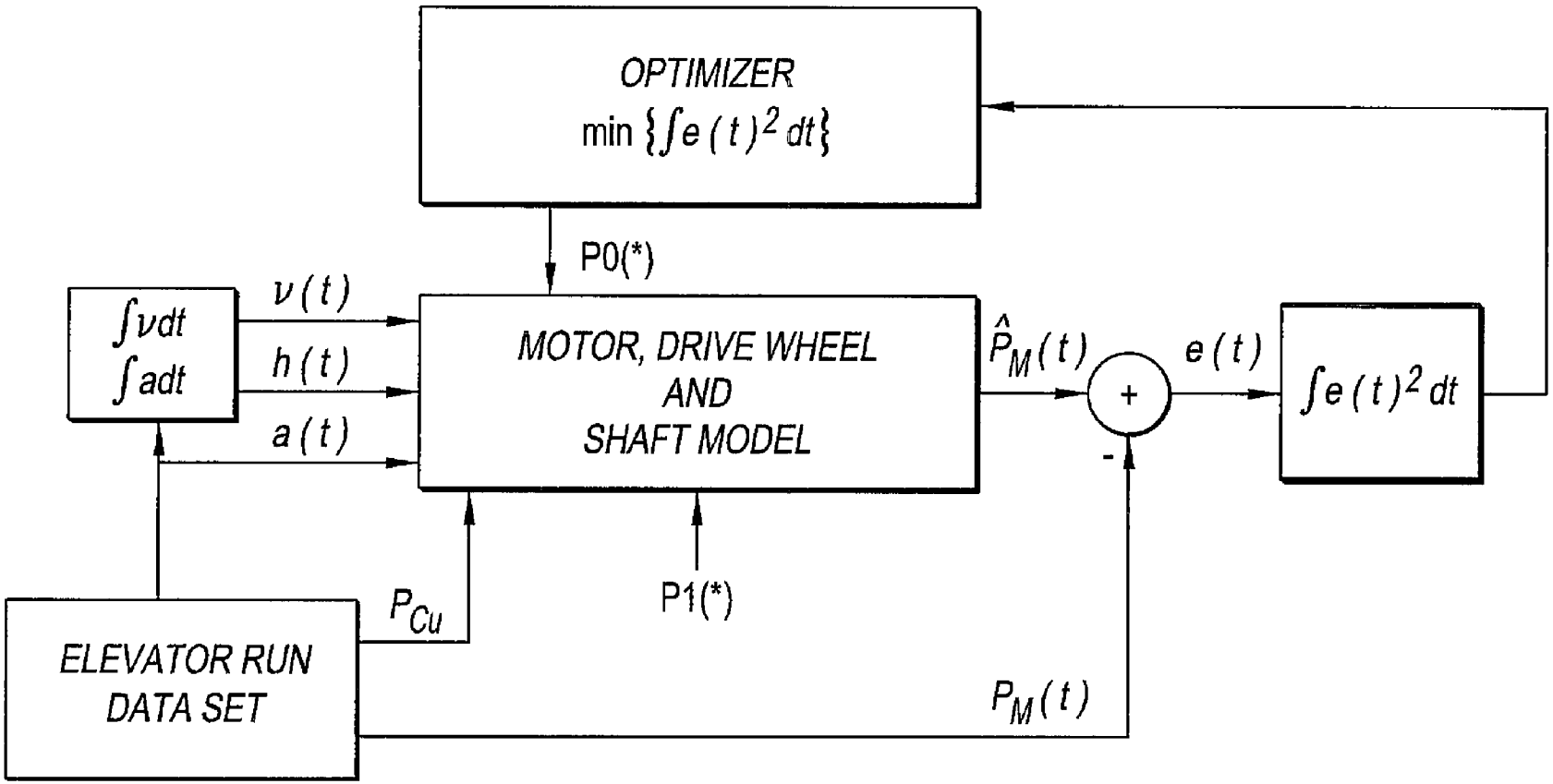
FIG. 5 represents an embodiment according to the invention.

FIG. 5 represents an embodiment of the invention wherein the gain of the car load weighing device and the magnitude of its zero error are determined. The load-weighing device of the elevator car is used for the measurement of the load Q in the elevator car, such as the total mass of passengers. The load-weighing device is a measurement arrangement based e.g. on strain gauges, wherein the strain gauge signal $u_{LWD}$, which is proportional to the car load Q, is amplified and converted into a digital measurement signal e.g. in the elevator control system. Q can be calculated from the equation below:

$$Q=G^*u_{LWD}+O$$

where G is car the load signal gain and O is the zero offset. As the present invention can also be used for estimation of the car load Q, it is possible, by using the power model, to produce measurement pairs from an estimated car load Q and a corresponding measurement signal $u_{LWD}$ of the car load weighing device during elevator operation, preferably during normal transporting operation. In the example according to FIG. 5, the power model uses car acceleration a(t) as the first input parameter and the copper loss $P_{Cu}$ of the motor as the second input parameter. A parameter set P1(●) is assigned to the power model, said parameter set comprising the status parameters needed in the calculation of Q, which have been determined e.g. by test operation of the elevator. From an optimizer is obtained a parameter set P0(●) comprising an estimate of the car load Q or a quantity proportional to it, on the basis of which the value of Q can be calculated. After a sufficient number of measurement pairs Q, $u_{LWD}$ have been collected, the gain G and zero offset O values can be calculated using linear regression. The application makes it possible to automatically calibrate the measurement obtained from the car load weighing device. The measurement signal from the car load weighing device can also be corrected on a regular basis, e.g. once a day, which will improve the riding comfort, inter alia, because the elevator control system receives accurate data from the car load weighing device regarding the load in the elevator car. Moreover, sudden differences in the measured and estimated car load or changes in the gain and/or zero offset of the car load weighing device can be detected quickly and this information can be used e.g. for indication of failure situations and in general for monitoring of the elevator system. By keeping statistics on the gain and zero offset values e.g. in a maintenance center on a long-time basis, it is possible to make inferences as to the maintenance required by the elevator system.

The invention is not exclusively limited to the above-described embodiment examples, but many variations are possible within the scope of the inventive concept defined in the claims.

The invention claimed is:

1. A system for adjusting status parameters in a transport system, said system comprising:

a power model that contains a number of parameters describing power flow in the transport system, wherein the system includes at least a first input parameter and a second input parameter, the values of which are determined by being read or measured, and a system portion for updating said power model using at least the first read or measured input parameter, and a system portion for adjusting the value of at least one status parameter using at least the updated power model and the second input parameter.

2. The system claim 1, further comprising:

a system portion for estimating, for the power flow at at least one point in the transport system, a first power flow value using the power model and a power flow second value corresponding to the first power flow value derived from the aforesaid second input parameter, and a system portion for adjusting at least one of the status parameters of the transport system on the basis of a deviation between the aforesaid first and second power flow values.

3. The system of claim 1, wherein the transport system comprises a transport apparatus and a motor drive mechanically connected to it, and further comprising:

a system portion for estimating a first value, using the power model, of power flow at a point of connection between the motor drive and the transport apparatus, and a system portion for deriving a second power flow value from the second input parameter, at said point of connection, and a system portion for adjusting at least one status parameter of the transport apparatus on the basis of the deviation between the aforesaid first and second power flow values.

4. The system of claim 1, further comprising:

a system portion for adjusting the aforesaid first power flow value towards the aforesaid second power flow value by adjusting the value of at least one status parameter.

5. The system of claim 1, wherein the transport system is an elevator system and the aforesaid input parameters of the elevator system include at least one of motor drive input power, a motor supply power, a motion of the drive wheel of an elevator system motor, a motion of the elevator car, and a magnetization power of the motor at zero speed.

6. The system of claim 5, wherein the aforesaid status parameters of the elevator system comprise at least one of the following: elevator car load, mass of elevator car, mass of counterweight, motor efficiency, efficiency of motor supply device, elevator inertia mass, elevator shaft friction, elastic constant of elevator ropes elevator system balancing error, and elevator rope slip on drive wheel.

7. The system of claim 5, characterized in that the transport system status parameters (4) are pre-selected on the basis of elevator system configuration, the first input parameter contains momentary elevator motor motion data, the second input parameter contains momentary elevator motor supply power corresponding to momentary elevator motor motion data, the third input parameter contains momentary magnetization power corresponding to zero speed of the elevator motor, the first value of the power transmitted by the elevator motor drive wheel and corresponding to the elevator motor motion data is based on an estimate obtained by applying the power model using elevator motor motion data, elevator motor magnetization power and the aforesaid status parameters, a second value for the power transmitted by the elevator motor drive wheel is based on the supply power corresponding to momentary elevator motor motion data, and wherein the aforesaid first power flow value has been adjusted towards the aforesaid second power flow value by a further adjustment of at least one pre-selected parameter.

8. A method for adapting the parameters of a transport system, comprising:

providing a power model for the transport system, including parameters describing power flow in the transport system in the power model, determining at least a first transport system input parameter value and a second transport system input parameter value, updating the power model on the basis of at least the first input parameter value thus determined, and adjusting at least one transport system status parameter using at least the updated power model and the second input parameter value.

9. The method according to claim 8, further comprising, with respect to use of the power model:

estimating a first value for the power flow at least one point in the transport system, deriving a second value corresponding to the first value for the power flow at the aforesaid at least one point in the transport system from the second input parameter, and adjusting at least one status parameter of the transport system on the basis of the deviation between the aforesaid first and second power flow values.

10. The method according to claim 8, further comprising:

adjusting the value of at least one status parameter in such manner that the aforesaid first power flow value is thereby adjusted towards the aforesaid second power flow value.

11. The method according to claim 8, wherein the transport system is an elevator system, further comprising:

pre-selecting the elevator system status parameters, running the elevator under conditions of heavy and light load and reading at least the elevator motor motion data, the momentary supply power corresponding to the elevator motor motion data and the motor magnetization power corresponding to zero speed of the elevator motor, indicating the power flow at the elevator motor drive wheel by a first value based on the pre-selected status parameters, measured elevator motor drive wheel speed data and the motor magnetization power, deriving a second value for power flow at the elevator motor drive wheel corresponding to the first power flow value on the basis of measured elevator motor supply power, and adjusting the aforesaid first power flow value to a value substantially corresponding to the aforesaid second power flow value by updating at least one pre-selected status parameter.

12. The system according claim 1, wherein at least one of said parameters comprises a number of mutually successive parameter elements, and that at least one aforesaid power flow value comprises a number of mutually successive power values corresponding to the parameter element values.

13. The method claim 8, further comprising:

determining gain G and/or zero offset O of a car load weighing device of the transport system by using the power model.

14. The method of claim 13, further comprising:

monitoring operation of the car load weighing device monitoring changes occurring in the gain and/or zero offset O of the car load weighing device in short and/or long term in order to detect failure situations and/or to determine the need for maintenance.

15. The system claim 2, wherein the aforesaid first power flow value has been adjusted towards the aforesaid second power flow value based on an adjustment of a value of at least one status parameter.

16. The system of claim 3, wherein the aforesaid first power flow value has been adjusted towards the aforesaid second power flow value based on an adjustment of a value of at least one status parameter.

17. The system of claim 2, wherein the transport system is an elevator system and the aforesaid input parameters of the elevator system include at least one of the following: motor drive input power, motor supply power, motion of a motor drive wheel, motion of an elevator car, and magnetization power of a motor at zero speed.

18. The system of claim 3, wherein the transport system is an elevator system and the aforesaid input parameters of the elevator system include at least one of the following:motor drive input power, motor supply power, motion of a motor drive wheel, motion of an elevator car, and magnetization power of a motor at zero speed.

19. The system of claim 4, wherein the transport system is an elevator system and the aforesaid input parameters of the elevator system include at least one of the following: motor drive input power, motor supply power, motion of a motor drive wheel, motion of an elevator car, and magnetization power of a motor at zero speed.

20. The system of claim 6, wherein the transport system status parameters are pre-selected on the basis of system configuration, the first input parameter contains momentary elevator motor motion data, the second input parameter contains momentary elevator motor supply power corresponding to momentary elevator motor motion data, the third input parameter contains momentary magnetization power corresponding to zero speed of the elevator motor, the first value of the power transmitted by the elevator motor drive wheel and corresponding to the elevator motor motion data is an estimate obtained by applying the power model using elevator motor motion data, the elevator motor magnetization power and the aforesaid status parameters, and wherein a second value for the power transmitted by the elevator motor drive wheel is derived from the supply power corresponding to the momentary elevator motor motion data, and wherein the aforesaid first power flow value has been adjusted7 towards the aforesaid second power flow value by a further adiustment of at least one pre-selected parameter.

* * * * *